United States Patent [19]

Lockett, III et al.

[11] Patent Number: 4,553,786

[45] Date of Patent: Nov. 19, 1985

[54] INFANT SEATING AND LOUNGE UNIT

[75] Inventors: William Lockett, III, 9902 W. Layton Ave., Littleton, Colo. 80123; Edward D. Oliver, Manchester, N.H.

[73] Assignee: William Lockett, III, Littleton, Colo.

[21] Appl. No.: 521,653

[22] Filed: Aug. 10, 1983

[51] Int. Cl.[4] ..... A47C 1/12

[52] U.S. Cl. ..... 297/440; 297/457; 297/250

[58] Field of Search ..... 297/250, 440, 457, 311, 297/467

[56] References Cited

U.S. PATENT DOCUMENTS

| | | | |
|---|---|---|---|
| 2,848,040 | 8/1958 | Chernivsky | 297/296 |
| 2,988,136 | 6/1961 | Kowalczyk | 297/311 |
| 3,017,220 | 1/1962 | Chernivsky . | |
| 3,071,413 | 1/1963 | Flint et al. . | |
| 3,110,519 | 11/1963 | Chernivsky . | |
| 3,235,306 | 2/1966 | Chernivsky . | |
| 3,656,808 | 4/1972 | Chang . | |
| 4,062,589 | 12/1977 | Klein et al. | 297/440 X |
| 4,141,590 | 2/1979 | Lafer | 297/440 |
| 4,339,488 | 7/1982 | Brokmann | 428/100 |

*Primary Examiner*—Kenneth Downey
*Attorney, Agent, or Firm*—John E. Reilly

[57] ABSTRACT

An infant chair is comprised of upper and lower resilient wire frames with the lower frame having a horizontal ground-engaging base with opposite side members diverging forwardly from a common crosspiece. The forward portions of the side members incline upwardly and rearwardly for connection to the upper frame. The upper frame has back, seat and leg support portions and releasable connectors interconnect the inclined side member upper ends to the back, seat and leg supports of the upper frame. The back, seat and leg support portions are encased by a removable, flexible covering.

19 Claims, 11 Drawing Figures

INFANT SEATING AND LOUNGE UNIT

This invention generally relates to infant seats; and more particularly relates to a novel and improved chair having a resilient marginal frame comprising a removable base with inclined leg rest and back rest portions, and a fabric cover that is separably applied to the resilient frame.

BACKGROUND AND FIELD OF THE INVENTION

In the past, efforts have been made to develop an infant chair which is durable, lightweight and relatively simple to manufacture but which is above all safe for even newborn infants. To this end, many of the chairs proposed to date employ wire or tubular frames, which may be rigid or flexible, defining a base and the perimeter of a seat and backrest portion, and an infant-supporting cover of fabric and the like which is applied to the frame such that the baby is cradled therein in a sitting or semi-reclining position. Examples of the prior art include U.S. Pat. Nos. 2,848,040; 3,110,519; and 3,235,306; all to Chernivsky, which are directed generally to baby chairs having a resilient tubular frame consisting of a separable base and inclined seatback portions interengaged by tubular connectors and a pouch-like or fitted fabric cover which is slipped over the seatback portion of the frame so as to create a back rest and seat for the baby. A belt and crotch strap may be provided to hold the baby in the chair. U.S. Pat. No. 3,017,220 to Chernivsky discloses an infant chair of similar configuration additionally provided with a pair of U-shaped members which form side arms and a forward arm rest. A fitted fabric cover is attached to the back and arms; in addition, the fabric section defining the seat is supported by a strap secured to the forward armrest. U.S. Pat. No. 2,988,136 to Kowalczyk discloses the use of a fabric-covered frame portion which makes up the back and leg rests of an infant's chair. The upper and lower panels are connected by threaded fastening means to leg members attached to a rectangular base frame. Yet another approach to a flexible infant chair frame construction is illustrated in U.S. Pat. No. 3,656,808 to Chang, which teaches a single continuously curved tubular frame member.

Although there has been much advancement in the art, there remains a need for a portable frame-type infant seat in which the baby's weight is centered over the base for improved stability on a variety of surfaces thereby resisting both forward and lateral tipping.

SUMMARY OF THE INVENTION

It is therefore an object of the present invention to provide for a novel and improved infant seat with a resilient frame having means for supporting the legs of an infant and removable base means configured to provide balanced support on a variety of surfaces.

It is another object of the present invention to provide for a novel and improved infant seat having a one-piece fabric seat cover which is extremely comfortable for the infant and may be easily removed for cleaning or replacement.

It is a further object of the present invention to provide an infant chair wherein novel connector means permits easy assembly and disassembly as well as ready convertibility from a chair with a floor stand to a reclining lounge or baby carrier.

It is yet another object of the present invention to provide a novel and improved infant seat which is extremely durable, yet relatively inexpensive to manufacture.

In accordance with the present invention, there has been devised a novel and improved infant chair comprised of upper and lower resilient wire frame members. The lower frame member comprises a horizontal ground-engaging base having opposite side members diverging forwardly from a common crosspiece, the forward portions of the side members inclining upwardly and rearwardly for connection to the upper frame. The upper frame comprises a back and seat support portion and leg support portion. Releasable connecting means interconnect upper ends of the inclined side members of the lower frame to the back and seat support and leg support portions of the upper frame such that the back and seat support portion inclines rearwardly and upwardly from the inclined members of the lower frame and the leg support portion inclines forwardly therefrom. A flexible covering is releasably positioned over the back and seat support portion and the leg support portion.

The above and other objects, advantages and features of the present invention will become more readily appreciated and understood when taken together with the following detailed description of a preferred embodiment of the present invention in conjunction with the accompanying drawings, in which:

DETAILED DESCRIPTION OF PREFERRED EMBODIMENT

Figure 1:
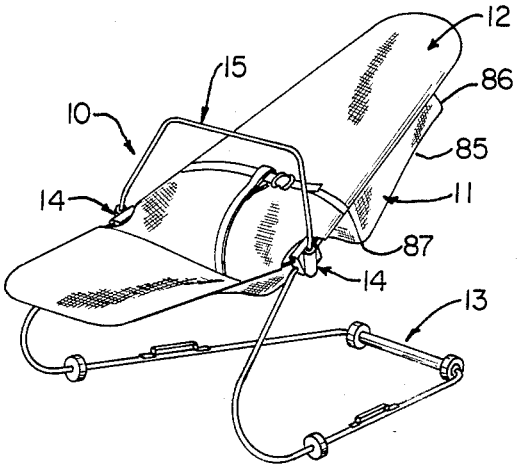
FIG. 1 is a perspective view of the infant chair in accordance with the present invention, illustrated in fully assembled form.

Referring to the drawings, and in particular to FIG. 1, an infant chair 10 essentially comprises a resilient upper frame 11 provided with a flexible fabric covering 12 and resiliently supported on a lower frame 13. Frame members 11, 13 are interconnected and assembled in properly angled relation by means of a connector flange 14 which is additionally adapted to support a toy bar 15 in spaced relation to a child seated in the chair.

Figure 3:
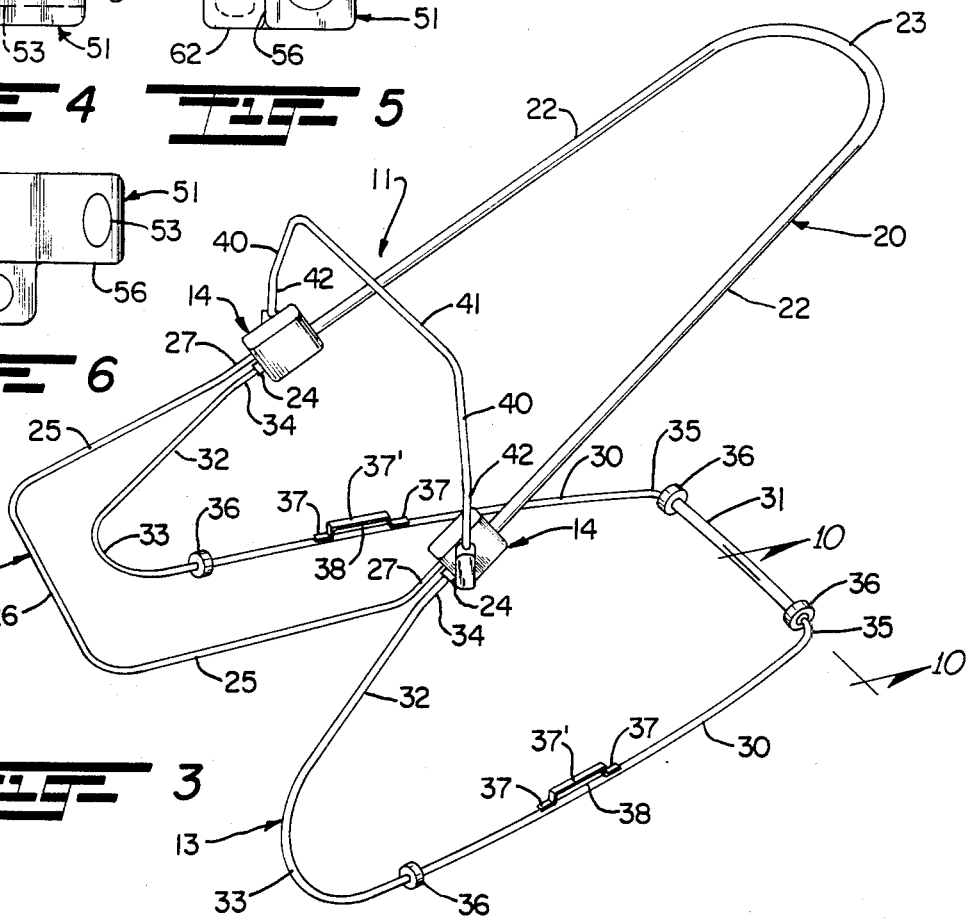
FIG. 3 is a perspective view of the infant chair with the fabric cover removed to illustrate the frame assembly.

FIG. 3 illustrates the configuration of the individual frame members 11, 13 and 15 in assembled relation to one another. Upper frame 11 includes a tubular back support frame 20 and a leg support frame 21. Back support frame 20 is generally U-shaped and comprises side members 22 joined by an upper curved section 23 and terminating in open socket ends 24. The lower leg supporting frame 21 is preferably of solid wire construction and includes side members 25 converging toward a transverse forward member 26. Terminal ends 27 of the sides 25 are bent at a slight angle upwardly from the longitudinal axis of the side members 25 for insertion into connector flange 14 as will be described further hereinbelow.

Figure 2:
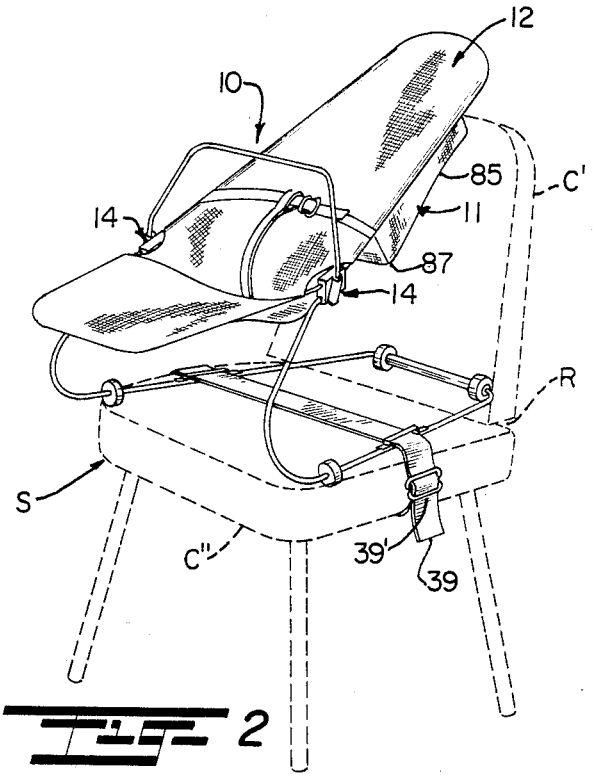
FIG. 2 is a perspective view of the infant chair of FIG. 1 positioned on and connected to a conventional chair, the latter illustrated in phantom.
Figure 10:
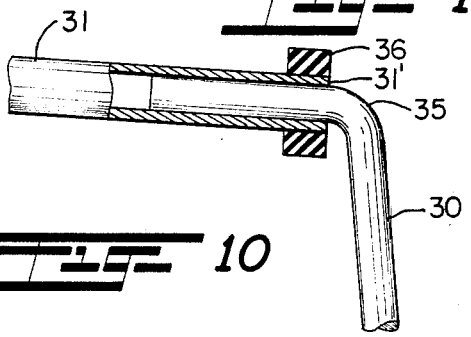
FIG. 10 is a partial section view taken along lines 10—10 of FIG. 3.

Lower frame 13 comprises opposite sides 30 diverging forwardly from opposite ends of a common tubular cross member 31. With specific reference to FIG. 10, side members 30 are bent inwardly as at 35 for tight-fitting insertion into tubular cross member 31 so as to form a relatively wide horizontal ground-engaging base of generally trapezoidal configuration when viewed in plan. The forward portions of side members 30 curve upwardly and return rearwardly as at 33 to form upstanding leg members 32. Leg members 32 converge upwardly and terminate in segments 34 which are substantially parallel to each other and are angled toward the horizontal with respect to the longitudinal axis of leg members 32 for interconnection with the upper frame 11. Referring again to FIG. 3, protective sleeves 36 of rubber or similar suitable material are provided at opposite ends of the cross member 31 and adjacent to the forward portions of side members 30 in order to protect the surface on which the chair is placed as well as to provide frictional engagement therewith. Further, narrow metal strips 37 provided with raised central portions 37' are affixed to intermediate side members 30 so as to form narrow rectangular slots 38 for retaining the chair-engaging strap 39 of FIG. 2.

Accessory bar 15 is a generally U-shaped member having arm portions 40 converging upwardly to join opposite ends of a transverse portion 41, the latter being spaced upwardly of the chair 10 at approximately the eye level of the child seated therein. Terminal segments 42 are angled inwardly away from the vertical axis of arms 40 so as to be substantially parallel with one another for removable insertion into the connector means 14.

Figure 4:
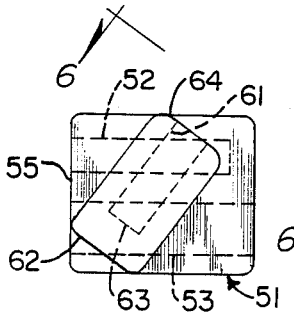
FIG. 4 is an enlarged side view of the frame connector means shown in FIGS. 1 to 3.
Figure 5:
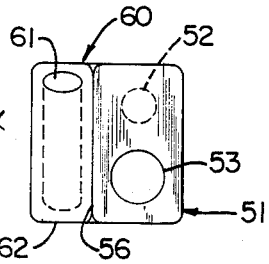
FIG. 5 is a top plan view of the frame connector means.
Figure 6:
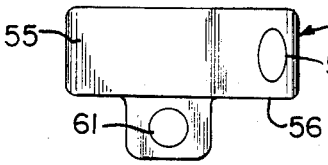
FIG. 6 is a sectional view taken along lines 6—6 of FIG. 5.

Interconnection of the frame components 11, 13, 15 is accomplished by means of the unitary connector flange 14, shown in detail in FIGS. 4 to 6, which comprises an elongated main body 51 having spaced longitudinal openings or channels 52, 53 therein. Channel 53 extends the entire length of body 51, and is slightly larger in diameter than channel 52, which extends only partially through body 51. Socket end 24 of the tubular back support frame 20 is installed preferably by permanently securing same in inner concentric relation within channel 53 such that the socket end 24 extends slightly beyond the lower surface 55 of the flange body 51. Terminal ends 27 of the leg support frame 21 are sized for insertion into the smaller channel 52 through the channel opening on the lower surface 55 of the flange 14 and are releasably retained by frictional engagement therein. The outwardly facing surface 56 of flange 14 further includes an elongated laterally offset body 60 having a longitudinal channel 61 therethrough which is angularly inclined approximately at a 45° angle with respect to channels 52, 53. Inclined channel 61 is adapted for tight-fitting but releasable insertion of the terminal segment 42 of accessory bar 15 therein. Channel 61 does not extend the entire length of offset body 60, the body being closed at its lower end 62 to provide a limit stop 63 for end 42' of terminal segment 42. It is recommended that channel 61 be of sufficient length to prevent removal of the bar by the infant; and the substantially vertical orientation of the connected accessory bar together with the frictional engagement between terminal segment 42 and channel 61 will inherently discourage such removal. The upper surface 64 of the body 60 is slightly rounded as shown in FIG. 4 to avoid sharp edges and prevent injury to the infant.

Figure 7:
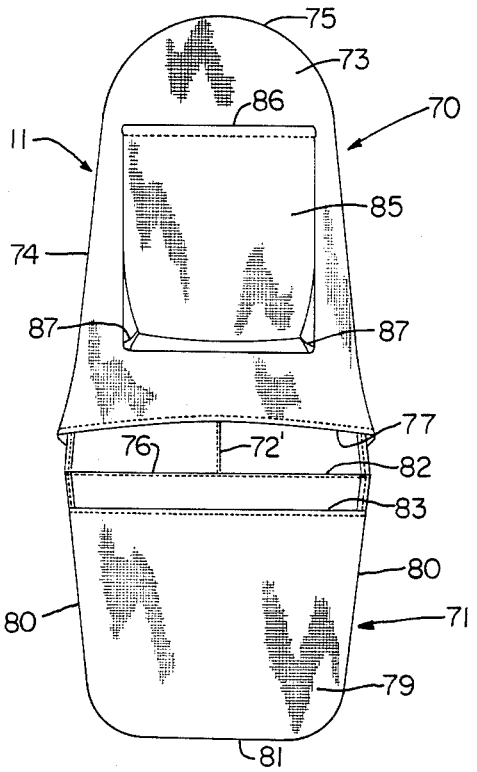
FIG. 7 is a rear view in elevation of the fabric cover shown removed from the frame.
Figure 8:
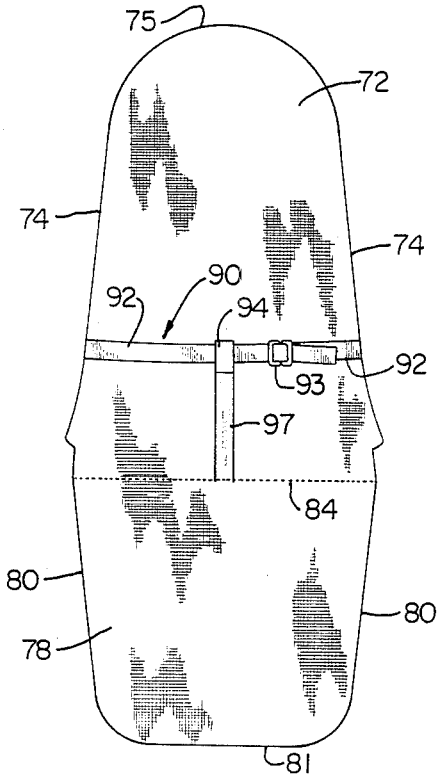
FIG. 8 is a front elevational view of the fabric cover shown in FIG. 7.
Figure 9:
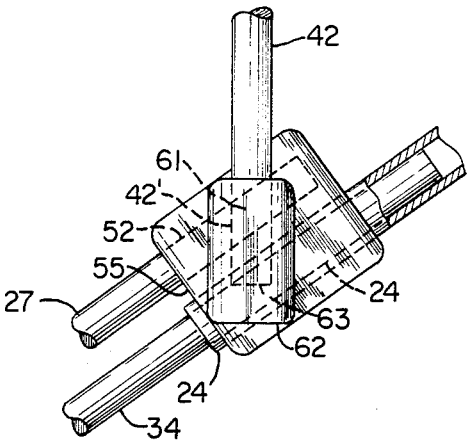
FIG. 9 is an enlarged fragmentary view partially in section of the frame connector means and the interconnected frame components.

The removable fabric cover 11 illustrated in FIGS. 7 and 8 comprises upper and lower frame-receiving portions 70, 71 having openings therein for insertion of back support frame 20 and leg support frame 21, respectively. Specifically the upper portion 70 includes front and back panels 72, 73 stitched at side 74 and along top 75 to generally correspond to the contours of the back support frame 20, although slightly larger to allow for ease of assembly. Free edges 76, 77 on the front and back panels 72, 73, respectively, define an opening for insertion of frame member 20. Front panel 72 of the upper cover portion 70 is additionally provided with a dart or tuck 72' extending a short distance upwardly from the front free edge 76 so as to form a hollow which supports the seat and lower back of the infant. Lower cover portion 71 is similar to the upper portion 70 and includes front and back panel 78, 79 joined along sides 80 and lower end 81 leaving front and back free edges 82, 83 to permit insertion of leg support portion 21 into the lower cover 71. The front free edge 82 on the lower cover portion 71 and the tucked edge 76 on the upper cover portion 70 are substantially coextensive and are joined together between opposite sides of the cover portion by stitching 84 to form a one piece cover. Back panels 73, 79 on both the upper and lower cover portions are shorter in length than the front panels 72, 78 in order to facilitate installation of the fabric cover 12 on the upper frame 11. Free edges 77 and 83 are preferably hemmed or finished in a suitable manner to provide an attractive appearance.

Upper cover portion 70 is further provided with a pocket 85 stitched to the back panel 73 thereof in a convenient and accessible location. Referring to FIG. 1, it will be seen that the pocket does not lie flat against the back panel 73 but is in fact stitched at lower corners 87 to create a pouch accessible through upper opening 86 for storage of infant care articles. Chair-engaging strap 39 may also be placed therein when not in use. Front panel 72 of upper cover portion 70 also includes an infant retaining belt 90 and crotch strap 97. The belt may be of any appropriate design but is preferably a flexible fabric type comprising a pair of strips 92 stitched to opposite sides 74 of the cover portion 70 at the waist level of the seated infant, and fastening means, such as a D-ring or interfitting buckle fasteners are associated therewith. Crotch strap 97 is stitched into the seam 84 connecting front free edges 76, 82 intermediate the sides thereof and is provided with a loop 94 at its upper end which loosely and slidably engages the strips 92 threaded therethrough.

The flange 14 greatly simplifies interconnection of the frame components as will be apparent from a consideration of the assembly procedure. In the preferred method the lower frame or base 11 is first constructed by inserting each of the inwardly turned ends 35 of sides 30 into an opposite open end 31' of connecting cross member 31. The lower frame may then be set upon a plane surface such as the floor or a table to facilitate subsequent assembly steps. At the outset it should be noted that all frame components are somewhat resilient and may be flexed or sprung as necessary to facilitate interconnection thereof. Tubular back support frame 20, having its opposite socket ends 24 installed in channels 53 of connector flanges 14, is positioned so that socket ends 24 are axially aligned with angled segments 34 of legs 32, whereupon segments 34 are then inserted into sockets 24 and frictionally engaged therein. The back support frame 20 is consequently inclined at an angle of approximately 30° to 40° with respect to the horizontal base defined by sides 30 and cross member 31. At this stage, it is recommended that the upper portion 70 of fabric cover 12 be slipped over the back support frame 20 and pulled downwardly therealong until seam 84 is approximately aligned with the bottom surfaces 55 of connector flanges 14 on either side thereof. Leg support frame 21 is then inserted into the opening defined by lower cover portion 71 and is positioned so that each opposite, upwardly angled terminal end 27 may be inserted into a channel 52 opening on the lower surface 55 of flange 14. It may at this point be necessary to readjust the fabric cover 12 on the upper frame 11 so that the hollow seat defined by tuck 72' is in proper position, depending from between the sides 22 of the back support frame 20. As the various frame components are interfitted, it is desirable that all connecting ends be pushed as far as possible into their receiving sockets or channels to insure proper tight-fitting engagement for frame members and the resultant stability of the assembled chair.

Interconnection of the accessory bar 15 is accomplished by inserting the opposite terminal segments 42 downwardly into the vertical channel 61 in the laterally offset body 61 of flange 14 until the ends 42' of segments 42 abut the stop 63 in the lower end of the channel 61. The infant may use the bar as a hand grip or, if desired, toys having annular connection means thereon, such as, large colored beads may be slipped onto the transverse portion 41 of the bar prior to its installation.

FIG. 1 illustrates the infant chair 10 in fully assembled form. It will be appreciated that the relative inclinations of the back support frame 20 and the leg support frame 21 provide support for the infant in a comfortable semi-reclining position. The connector flange 14 permits rapid and simplified assembly of the frame components into proper angled relation with little or no adjustment of individual parts and without the use of tools. When the baby is placed in the chair, he will naturally settle into the hollowed area of the seat created by the tuck 72' and his weight will be centered over a relatively wide base defined by the lower frame 13 so that forward or lateral tipping of the chair is virtually impossible. The weight of the baby further causes the frame members to bear against one another and against the connector flange sockets or channels so as to tend to retain the members in tight-fitting connected relation. The leg support frame 21 holds the infant's legs at a comfortable angle and further since the legs are not allowed to dangle over the edge of the seat, it is unlikely that the child will be able to upset the seat by himself.

The assembled infant chair 10 may be placed on any substantially flat surface or, as illustrated in FIG. 1, may also be adapted for placement on a typical chair S of the type having a space or gap R between the seatback C' and the seat cushion C''. In positioning the infant chair 10 the rear portion of lower frame 13, including cross member 31 and the rearmost portions of sides 30, is inserted through the space R until strap-receiving slots 38 are centered over the seat cushion C'. In order to prevent forward shifting of the infant seat 10, a strap 39 is threaded through the slots 38 and around the seat cushion C'' in encircling relation thereto and is secured with suitable fastening means such as a buckle 39'.

Figure 11:
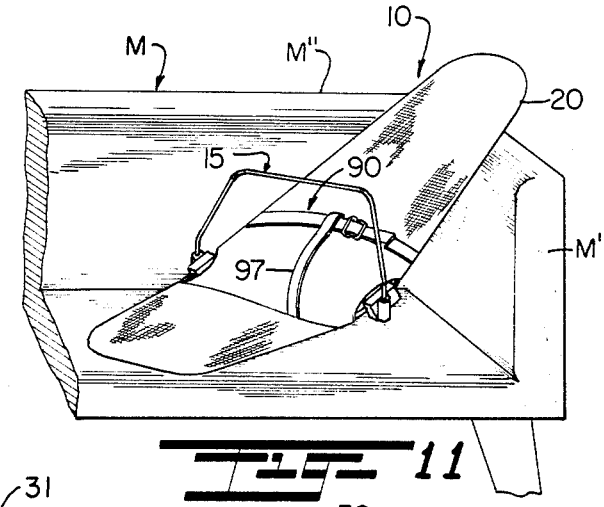
FIG. 11 is a perspective view of the infant chair with lower frame removed illustrated in position on a couch or the like for use as a lounge.

FIG. 11 illustrates conversion of the infant seat 10 into a lounge or bed which may be placed on a couch M or a large armchair. For this particular application the entire lower frame portion 13 is removed by withdrawing connecting segments 34 from the socket ends 24 installed in the flange 14. The lounge is then positioned in a corner of the couch such that the back support portion 20 is propped at the desired angle by the arm rest M' and is braced between the arm rest and the back M'' of the couch so that the baby is supported in a comfortable position and lateral tipping of the lounge 10 is avoided.

It is to be understood that while preferred and modified forms of invention have been described various modifications and changes may be made in the construction and arrangements or elements without departing from the spirit and scope thereof as defined by the appended claims.

We claim:

1. An infant chair comprising:

upper and lower frame members, said lower frame member having a substantially horizontal ground-engaging portion with opposite sides extending forwardly from a common cross member, and upwardly and rearwardly inclined portions at forward ends of said sides of said lower frame, said upper frame having a back and seat support portion and a lower leg support portion; and releasable connector means releasably interconnecting upper extremities of said inclined portions of said lower frame to said back and seat and leg support portions whereby said back and seat support portions incline rearwardly and upwardly from their connection to said inclined portions and said leg support portion inclines forwardly from its connection to said inclined portion, a body having spaced longitudinally extending openings therein, each of said inclined portions and said support portions terminating in connecting ends releasably insertable into said openings, said leg support portion having connecting ends inserted into one of said openings and said inclined portions in said back and seat support portions having connecting ends insertable into opposite ends of the other of said longitudinal openings, and a covering positioned over said back and seat support portion and said leg support portion.

2. An infant chair according to claim 1, said upper and lower frames defined by resilient wire frame members.

3. An infant chair according to claim 1, said upwardly and rearwardly inclined portions defined by reverse curved wire frame members.

4. An infant chair according to claim 1, said ground-engaging portion defined by a flat horizontally extending wire frame of generally U-shaped configuration in a horizontal plane and said inclined portions each defined by a wire frame member of generally U-shaped configuration in a vertical plane.

5. An infant chair according to claim 1, each said releasable connector means including a laterally offset socket portion provided with a longitudinally directed opening therein, and a toy bar having opposite connecting ends insertable into said openings of said laterally projecting socket portions.

6. A convertible chair and lounge comprising in combination:

a base wire frame member having a flat horizontal portion defined by opposite sides diverging forwardly from a common cross member, a pair of leg frame members defined by reverse curved wire frame portions inclinding upwardly and rearwardly from said opposite sides of said base wire frame member and terminating in upper base frame connecting ends;

an upper frame member having a first generally U-shaped wire frame terminating in lower connecting ends on opposite sides thereof and defining an upper back and seat support portion, and a second generally U-shaped wire frame terminating in upper connecting ends on opposite sides thereof, said second generally U-shaped wire frame defining a lower leg support portion;

releasable socket connector means releasably interconnecting each of said frame connecting ends to each of said lower and upper connecting ends of said first and second U-shaped wire frames whereby said first wire frame inclines rearwardly and upwardly from its connection to said releasable connector means and said second wire frame inclines forwardly and downwardly from its connection to said releasable connector means, said upper base frame connecting ends insertable into inner concentric relation to said lower connecting ends, said releasable socket connector means comprising an elongated body of generally rectangular configuration having a pair of spaced longitudinally extending openings therein, said first U-shaped wire frame comprising a tubular member, each said lower connecting end insertable into an upper end of one of said longitudinal openings in said releasable socket connector means, each said upper base frame connecting end inserted into the opposite lower end of said one longitudinal opening and into inner concentric relation to said lower connecting end; and first and second flexible slipcovers encasing said upper and second frames, respectively, with the open ends of said slipcovers overlapping one another.

7. A convertible chair and lounge according to claim 6, said reverse-curved wire frame portion being of generally U-shaped configuration in a vertical plane.

8. A convertible chair and lounge according to claim 6, each of said upper connecting ends of said second U-shaped wire frame being insertable into a lower end of a second said longitudinal opening.

9. A convertible chair and lounge according to claim 6, wherein said third longitudinal opening includes limit stop means at the lower end thereof.

10. A convertible chair and lounge according to claim 6 wherein said opposite sides of said base wire frame member includes means for releasable interconnection to said common cross member.

11. A convertible chair and lounge according to claim 10, said common cross member being of hollow tubular configuration and said opposite sides are provided with inwardly directed connecting ends for insertion into inner concentric relation within said tubular cross member.

12. A convertible chair and lounge according to claim 6, each said flexible slip cover defining a hollow interior adapted for insertion of one of said first and second wire frames.

13. A convertible chair and lounge according to claim 12, wherein said first slip cover comprises front and back panel portions having corresponding sides and upper ends joined together by a line of stitching substantially corresponding to the outer peripheral edge of said first wire frame.

14. A convertible chair and lounge according to claim 13, said second flexible slip cover comprising front and back panel portions having corresponding opposite sides and lower ends joined together by a line of stitching substantially corresponding to the outer peripheral edge of said second wire frame.

15. A convertible chair and lounge according to claim 14, wherein said first and second flexible slip covers are stitched together along a portion of said overlapping open ends on said front panels.

16. A convertible chair and lounge according to claim 15, wherein said first slip cover includes a central tuck adjacent said lower connecting end of said upper frame defining a hollow for supporting the seat and lower back of an infant.

17. An infant chair comprising:

upper and lower frame members, said lower frame member having a substantially horizontal ground-engaging portion with opposite sides extending forwardly from a common cross member, and upwardly and rearwardly inclined portions at forward ends of said sides of said lower frame, said upper frame having a back and seat support portion and a lower leg support portion; and releasable connector means releasably interconnecting upper extremities of said inclined portions of said lower frame to said back and seat and leg support portions whereby said back and seat support portions incline rearwardly and upwardly from their connection to said inclined portions and said leg support portion inclines forwardly from its connection to said inclined portion, each said releasable connector means including a laterally offset socket portion provided with a longitudinally directed opening therein, and a toy bar having opposite connecting ends insertable into said openings of said laterally projecting socket portions.

18. A convertible chair and lounge comprising in combination:

a base wire frame member having a flat horizontal portion defined by opposite sides diverging forwardly from a common cross member, a pair of leg frame members defined by reverse curved wire frame portions inclining upwardly and rearwardly from said opposite sides of said base wire frame member and terminating in upper base frame connecting ends;

an upper frame member having a first generally U-shaped wire frame terminating in lower connecting ends on opposite sides thereof and defining an upper back and seat support portion, and a second generally U-shaped wire frame terminating in upper connecting ends on opposite sides thereof, said second generally U-shaped wire frame defining a lower leg support portion;

releasable socket connector means releasably interconnecting each of said frame connecting ends to each of said lower and upper connecting ends of said first and second U-shaped wire frames whereby said first wire frame inclines rearwardly and upwardly from its connection to said releasable connector means and said second wire frames inclines forwardly and downwardly from its connection to said releasable connector means, said upper base frame connecting ends insertable into inner concentric relation to said lower connecting ends; and first and second flexible slipcovers encasing said first and second frames with the open ends of said slipcovers overlapping one another.

19. A convertible chair and lounge comprising in combination:

a base wire frame member having a flat horizontal portion defined by opposite sides diverging forwardly from a common cross member, a pair of leg frame members defined by reverse curved wire frame portions inclining upwardly and rearwardly from said opposite sides of said base wire frame member and terminating in upper base frame connecting ends;

an upper frame member having a first generally U-shaped wire frame terminating in lower connecting ends on opposite sides thereof and defining an upper back and seat support portion, and a second generally U-shaped wire frame terminating in upper connecting ends on opposite sides thereof, said second generally U-shaped wire frame defining a lower leg support portion; and releasable socket connector means releasably interconnecting each of said frame connecting ends to each of said lower and upper connecting ends of said first and second U-shaped wire frames whereby said first wire frame inclines rearwardly and upwardly from its connection to said releasable connector means and said second wire frame inclines forwardly and downwardly from its connection to said releasable connector means, said upper base frame connecting ends insertable into inner concentric relation to said lower connecting ends, said releasable socket connector means comprising an elongated body of generally rectangular configuration having a pair of spaced longitudinally extending openings therein, said releasable socket connector means further including a second body laterally offset with respect to said first elongated body and provided with a third longitudinally extending opening at an inclined angle to said spaced longitudinal openings and adapted to receive a toy bar member having opposite connecting ends insertable into said third longitudinal opening.

* * * * *

UNITED STATES PATENT AND TRADEMARK OFFICE

CERTIFICATE OF CORRECTION

PATENT NO. : 4,553,786
DATED : 19 November, 1985
INVENTOR(S) : Lockett, W., III

It is certified that error appears in the above—identified patent and that said Letters Patent is hereby corrected as shown below:

Column 7 Line 15 Cancel "inclinding" and substitute -- inclining --

Column 9 Line 10 Claim 20, cancel "frames" and substitute -- frame --

Signed and Sealed this

*Thirteenth* Day of *May 1986*

[SEAL]

*Attest:*

DONALD J. QUIGG

*Attesting Officer*

*Commissioner of Patents and Trademarks*